United States Patent [19]

Barwasser

[11] Patent Number: 4,772,160

[45] Date of Patent: Sep. 20, 1988

[54] APPARATUS FOR MACHINING THE EDGE OF A LENS

[75] Inventor: Günter Barwasser, Neuss, Fed. Rep. of Germany

[73] Assignee: Wernicke & Co. GmbH, Düsseldorf, Fed. Rep. of Germany

[21] Appl. No.: 49,665

[22] Filed: May 13, 1987

[30] Foreign Application Priority Data

May 14, 1986 [DE] Fed. Rep. of Germany ... 8613032[U]

[51] Int. Cl.[4] ..... B23Q 11/08

[52] U.S. Cl. ..... 409/134; 51/217 L; 51/268; 409/138

[58] Field of Search ..... 51/105 LG, 124 L, 216 LP, 51/217 L, 268, 274, 284 E, 101 LG, 106 LG, 269, 272; 409/134, 138, 109, 111, 112

[56] References Cited

U.S. PATENT DOCUMENTS 3,332,172 7/1967 Stern ..... 51/101 LG 4,612,736 9/1986 Massard et al. ..... 51/105 LG X 4,656,995 4/1987 Merwin ..... 51/268 X

FOREIGN PATENT DOCUMENTS 96274 12/1983 European Pat. Off. ..... 51/101 LG

*Primary Examiner*—Gil Weidenfeld

*Assistant Examiner*—Steven C. Bishop

*Attorney, Agent, or Firm*—Becker & Becker, Inc.

[57] ABSTRACT

An apparatus for machining the edge of a lens. A fixed housing having a lid and a bulge is provided. Two half shafts mounted in the housing, with a lens being adapted to be held between these half shafts. A rotatable edge-machining tool in the form of a milling tool is disposed in the housing. A motor is provided for driving the milling tool, with this tool and the motor being movable relative to the housing in two horizontal coordinate directions, whereby the milling tool is adapted to be moved between a rest position in the bulge and an operating position that is in the housing but out of the bulge.

9 Claims, 2 Drawing Sheets

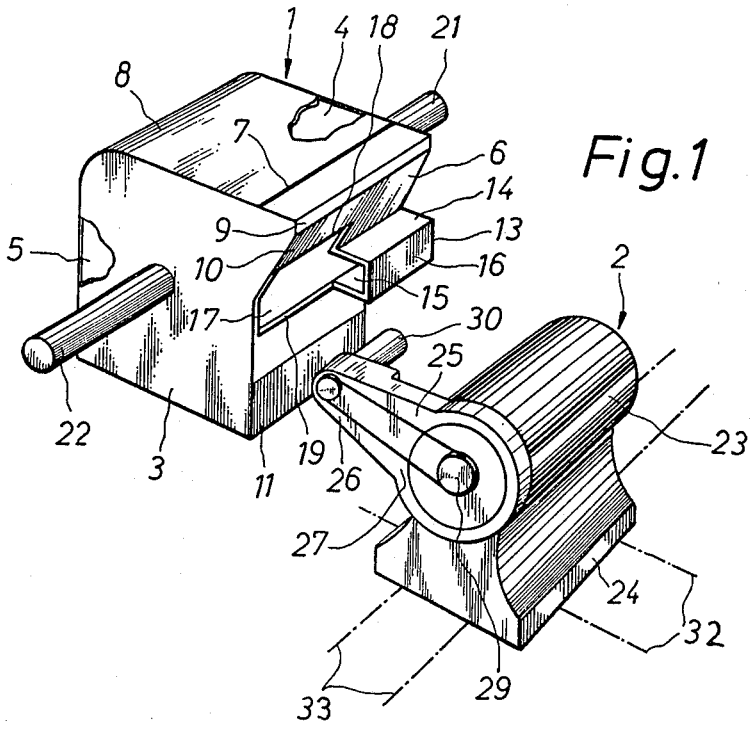
Fig.1
Fig. 2
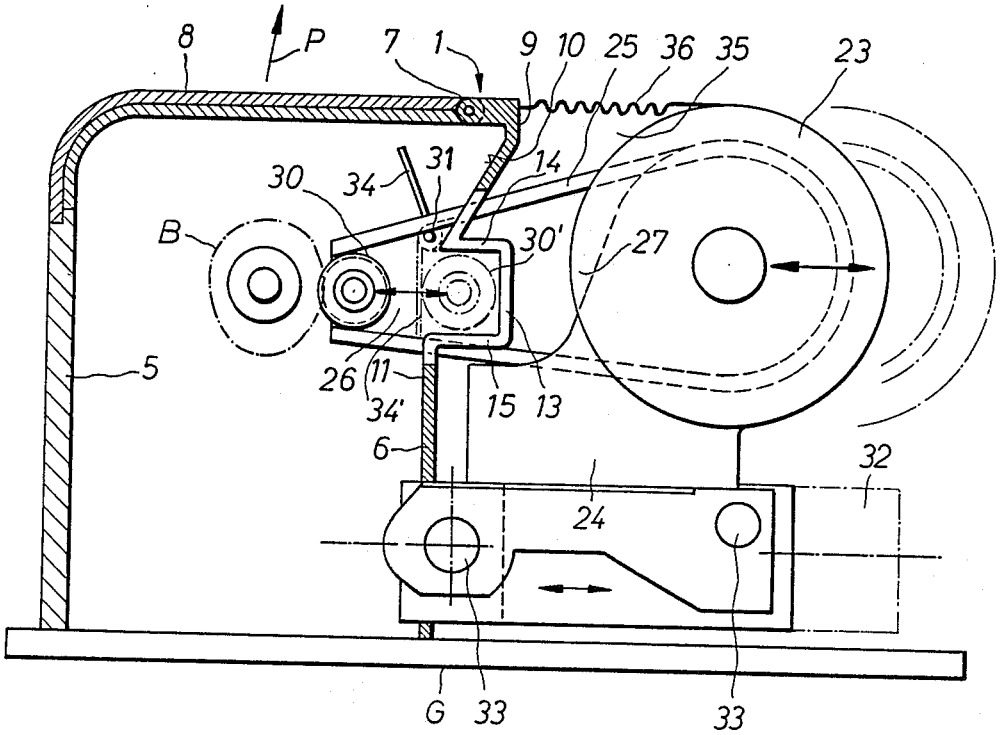

APPARATUS FOR MACHINING THE EDGE OF A LENS

BACKGROUND OF THE INVENTION

The present invention relates to an apparatus for machining the edge of a spectacle lens.

German Offenlegungsschrift No. 34 46 943 discloses a grinding station for a grinder, especially for chamfering or grooving a lens. In this known apparatus, the grinding disk and the lens are accommodated in a housing, with the half shafts, between which the lens is held, extending through the side walls of the housing, and with one of these half shafts being driven.

In contrast to this known state of the art, it is an object of the present invention to provide a high performance edge-machining apparatus for lenses, with which, above all, the safety of the operator is assured. Furthermore, this is to be achieved with structurally straightforward means that do not disrupt the machining operation.

BRIEF DESCRIPTION OF THE DRAWINGS

These objects, and other objects and advantages of the present invention, will appear more clearly from the following specification in conjunction with the accompanying schematic drawings, in which:

FIG. 1 is a perspective view of the two significant parts of one exemplary embodiment of the inventive apparatus, in particular the housing on the one part and the motor part with its arm and milling tool on the other hand;

FIG. 2 is a cross-sectional view through the apparatus of FIG. 2; and

SUMMARY OF THE INVENTION

Figure 3:
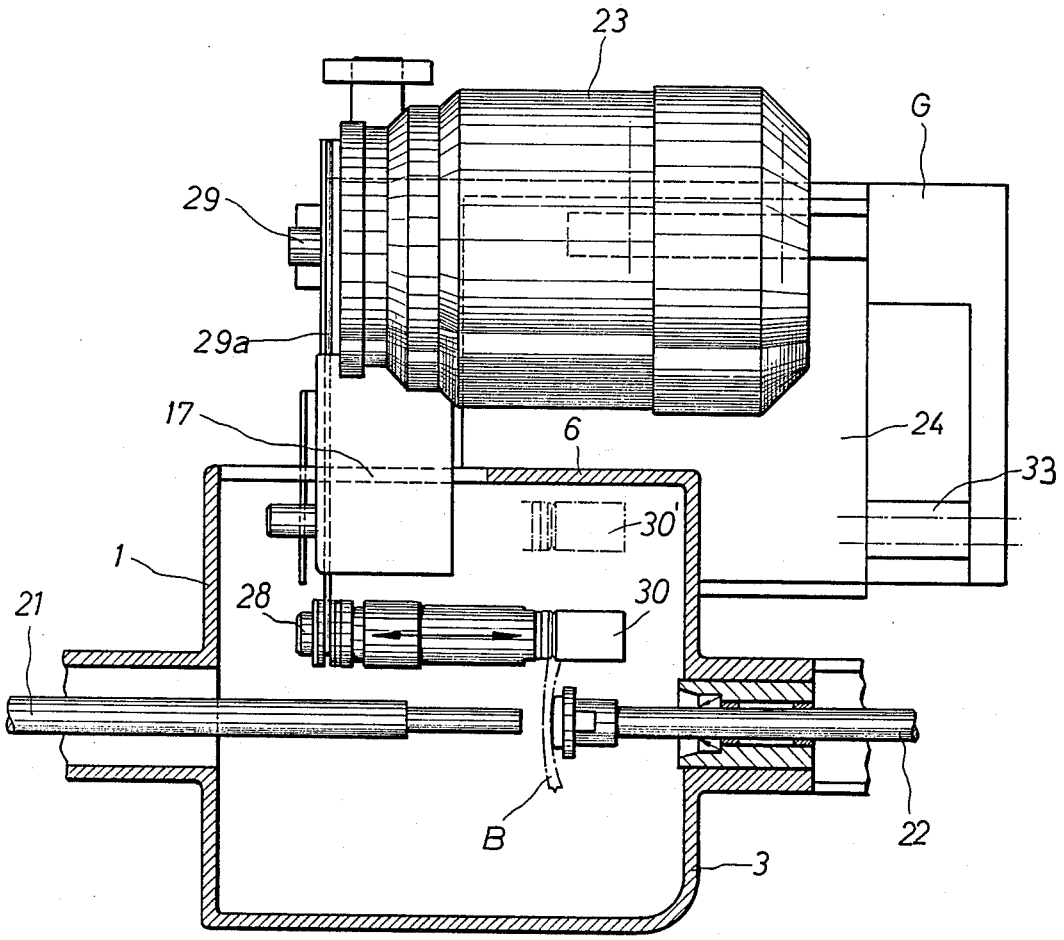
FIG. 3 is a partially cross-sectioned plan view of the apparatus of FIGS. 1 and 2.

The apparatus of the present invention comprises: a fixed housing that has a lid and a bulge; two half shafts mounted in the housing, with the lens being adapted to be held between these half shafts; a rotatable edge-machining tool that is in the form of a milling tool and is disposed in the housing; and a motor for driving the milling tool, with this tool and the motor being movable relative to the housing in two horizontal coordinate directions, whereby the milling tool is adapted to be moved between a rest position in the bulge and an operating position in the housing but out of the bulge.

The advantage that can be achieved with the inventive apparatus is that the user is protected from injury from the high-speed milling tool. Although it is possible to provide protection against such injuries in a number of ways, for example by not opening the flap of the housing until the milling tool has come to a stop, it is of course frequently the case that such safety measures are circumvented, so that the housing can be opened while the milling tool is still rotating. On the other hand, if the safety features are heeded, it is necessary to wait for a period of time to open the housing and remove the machine lens therefrom until after the high-speed milling tool has finally come to a standstill. The apparatus of the present invention reliably eliminates both of these drawbacks with structurally straightforward means.

Further specific features of the present invention will be described in detail subsequently.

DESCRIPTION OF PREFERRED EMBODIMENTS

Referring now to the drawings in detail, the inventive apparatus essentially comprises the housing 1 and the motor part 2. Both of these components are disposed on a base plate G (FIG. 2). The housing 1 essentially has a cubical shape, and includes the two side walls 3, 4, the front wall 5 that faces the user, and the back wall 6 that is adjacent to the motor part 2. The top of the housing 1 is formed by a pivotably disposed (see reference numeral 7 in FIG. 2) lid 8 that can be raised and lowered, i.e. opened and closed, in the direction of the arrow P.

The back wall 6 that faces the motor 23 has a vertical section 9 to which is connected an inclined section 10 that continues as the section 11. However, the back wall 6 can also have any other desired configuration. A bulge 13 is provided between the two back wall sections 10 and 11 in a vertical half of the housing 1, with the bulge 13 being disposed approximately halfway up. The bulge 13 comprises an upper wall 14, a lower wall 15, and a back wall 16. The bulge 13 has a specific size that will be described in detail subsequently in conjunction with the yet-to-be-described machining tool in the form of a milling tool. That side of the bulge that is disposed approximately in the vertical central longitudinal plane of the housing 1 is open, while that side of the bulge that is even with the side wall 4 is closed.

At the level of the bulge 13, the other vertical half of the housing 1 has an opening 17 in the back wall 6. The height of the opening 17 is at least equal to the vertical width of the support arm of the milling tool, which will be described subsequently, so that this support arm can extend through the opening 17 into the interior of the housing 1, where it can be adjusted in a horizontal direction. The top and bottom of the opening 17 are defined by the top edge 18 and the bottom edge 19.

The two half shafts 21 and 22 extend through the two side walls 3 and 4. The lens B (FIGS. 2 and 3), the edge of which is to be machined, is held in a known manner between the facing ends of the half shafts 21, 22.

The motor part 2 of the inventive apparatus includes a drive motor 23 on a support 24, which is horizontally disposed and has a rectangular shape, having the embodiment of either FIG. 1 or FIG. 2. A support arm 25 is securely disposed on the motor housing at the level of the opening 17 of the housing 1. The support arm 25 has a section 26 remote from the motor, and a section 27 that is proximate to the motor. The section 26 supports a shaft 28 that is disposed parallel to the motor shaft 29. The free end of the shaft 28 carries the milling tool 30 in an overhung manner. The shaft 28 is driven from the motor shaft 29 by a belt or cord **29*a*. The sizes of the aforementioned parts are such that the milling tool 30 can fit entirely in the bulge 13 when it is not in use. Furthermore, the configuration and arrangement of the arm 25, the milling tool 30, and the bulge 13** are such that the milling tool is capable of carrying out the necessary movements, relative to the lens, in a horizontal plane in the direction of two coordinates.

The support 24 that carries the motor 23 is, in a manner of a cross carriage, movable in the two aforementioned horizontal coordinate directions on guides 32, 33, which are known per se. Such cross carriage arrangements are known from lens grinding machines.

As can be seen from FIG. 2, the motor 23, along with the arm 25 and the milling tool 30 disposed thereon, can be moved in such a way that the milling tool 30 can be moved out of the operating position 30 into the position 30' of nonuse in the bulge 13, and vice versa (FIGS. 2 and 3). The pivotable lid 8 is connected with a known, not-illustrated device, such as a mechanical or electrical device, in such a way that the lid 8 can be opened only when the motor 23 is retracted and the milling tool 30 is moved into its position 30' in the bulge 13. The important thing is that now the motor 23 and the high-speed milling tool 30 can still turn without the operator suffering injury if the lid 8 is opened.

The bulge 13 advantageously has a hinge 31 for a flap 34 in front of the bulge. This flap can be moved into its open or closed position as a function of the movement of the arm 25. In other words, the flap 34 can be pivoted upwardly into the position 34 in order not to obstruct the machining process of the milling tool 30 when the latter is moved out of the bulge 13, whereas when the milling tool 30 is retracted back into the bulge 13 into the position 30', the flap 34 can assume the position 34' in order to cover the milling tool 30, which can continue to rotate in the bulge. The flap 34 could also be in the form of a sliding cover. In addition, the flap 34 may be connected to the lid 8, for movement therewith, via rods, levers, or the like.

Disposed between the housing 1 and the motor 23 is a flexible, bellows-like cover 36 for the space 35 between these two components; for ease of illustration, the upper portion only of this cover is shown. The side portions of this bellows extend down all the way to the support 24 of the motor 23.

The present invention is, of course, in no way restricted to the specific disclosure of the specification and drawings, but also encompasses any modifications within the scope of the appended claims.

What I claim is:

1. An apparatus for machining the edge of a lens having an axis, comprising:

a fixed housing that has a lid and a bulge having a longitudinal axis;

two half shafts mounted in said housing, with said lens being adapted to be held between said half shafts;

a rotatable edge-machining tool that is in the form of a milling tool having an axis and is disposed in said housing as well as being received entirely by said bulge of which the longitudinal axis is parallel to the lens axis and the tool axis; and a motor for driving said milling tool, with the latter and said motor being movable relative to said housing in two horizontal coordinate directions, whereby said milling tool is adapted to be moved between a rest position in said bulge to protect against danger of injury via said rotatable edgemachining tool and an operating position in said housing but out of said bulge.

2. An apparatus according to claim 1, which includes an arm that is connected to said motor, with said milling tool being disposed on said arm in an overhung manner.

3. An apparatus according to claim 2, in which said bulge extends over at least approximately half of the width of said housing.

4. An apparatus according to claim 3, in which said bulge has a square or rectangular cross-sectional shape, is oriented parallel to the shaft of said motor, and is disposed at least approximately halfway up said housing.

5. An apparatus for machining the edge of a lens, comprising:

a fixed housing that has a lid and a bulge;

two half shafts mounted in said housing, with said lens being adapted to be held between said half shafts;

a rotatable edge-machining tool that is in the form of a milling tool and is disposed in said housing;

a motor for driving said milling tool, with the latter and said motor being movable relative to said housing in two horizontal coordinate directions, whereby said milling tool is adapted to be moved between a rest position in said bulge and an operating position in said housing but out of said bulge; and an arm that is connected to said motor, with said milling tool being disposed on said arm in an overhung manner, said bulge extending over at least approximately half of the width of said housing, said bulge having a square or rectangular cross-sectional shape, being oriented parallel to the shaft of said motor, and being disposed at least approximately halfway up said housing, said bulge having a side that faces said half shafts, with a closure being provided to close off this side.

6. An apparatus according to claim 5, in which said closure is connected to said lid of said housing in such a way as to move therewith.

7. An apparatus for machining the edge of a lens, comprising:

a fixed housing that has a lid and a bulge;

two half shafts mounted in said housing, with said lens being adapted to be held between said half shafts;

a rotatable edge-machining tool that is in the form of a milling tool and is disposed in said housing;

a motor for driving said milling tool, with the latter and said motor being movable relative to said housing in two horizontal coordinate directions, whereby said milling tool is adapted to be moved between a rest position in said bulge and an operating position in said housing but out of said bulge; and an arm that is connected to said motor, with said milling tool being disposed on said arm in an overhung manner, said bulge extending over at least approximately half of the width of said housing, said bulge having a square or rectangular cross-sectional shape, being oriented parallel to the shaft of said motor, and being disposed at least approximately halfway up said housing, said housing having a back wall that faces said motor and in which said bulge is provided, with said back wall furthermore having, as an axial extension of said bulge, an opening for receiving said arm of said motor and milling tool in such a way that said arm can move therein in said two horizontal coordinate directions.

8. An apparatus according to claim 7, in which said bulge has a side facing said opening that is open, and a side that is even with a side wall of said housing.

9. An apparatus according to claim 7, in which said motor is disposed on a cross carriage, and in which a flexible cover is provided between said motor and said housing to cover said arm and said opening in said housing for said arm.

* * * * *